United States Patent [19]

Swanson

[11] 4,057,422

[45] Nov. 8, 1977

[54] ORE TREATMENT PROCESS

[76] Inventor: Rollan Swanson, 220 California Ave., Santa Monica, Calif. 90403

[21] Appl. No.: 662,507

[22] Filed: Mar. 1, 1976

Related U.S. Application Data

[63] Continuation-in-part of Ser. No. 467,099, May 6, 1974, Pat. No. 3,957,503.

[51] Int. Cl.[2] ..... C22B 19/04; C22B 13/08

[52] U.S. Cl. ..... 75/86; 75/21; 75/23; 75/77

[58] Field of Search ..... 75/21, 23, 72, 86, 83, 75/77

[56] References Cited

U.S. PATENT DOCUMENTS

| | | | |
|---|---|---|---|
| 3,004,846 | 10/1961 | Queneau | 75/21 |
| 3,057,714 | 10/1962 | Back | 75/23 |
| 3,388,870 | 6/1968 | Thumm | 75/21 |

*Primary Examiner*—Peter D. Rosenberg
*Attorney, Agent, or Firm*—Albert F. Kronman

[57] ABSTRACT

Disclosed is a process for extracting the following metals from ores containing same: iron, copper, zinc, arsenic, antimony, molybdenum, silver, and cadmium. In the process, the ore is concentrated and dehydrated prior to treating with a saturated hydrogen polysulfide or alkali metal polysulfide containing enough sulfur to sulfidize metals present in the ore in their nonsulfide forms and to completely oxidize the metals present in their sulfide form. This separates melt soluble sulfides (Cu, Fe, Mo, Sb, As) from melt-insoluble sulfides (Zn, Pb, Ag, Cd). The former are extracted with water to separate the water-soluble sulfides (Mo, As, Sb and any saturated polysulfide) from the water-insoluble sulfides (Cu, Fe,). The water-soluble sulfides are reacted with a more electropositive metal such as zinc to liberate them from their sulfur. The water-insoluble sulfides are dried and heated with a saturated hydrogen polysulfide or alkali metal polysulfide and the free metals are separated magnetically.

The melt-insoluble sulfides are heated with a saturated hydrogen polysulfide or alkali metal sulfide to liberate lead containing elemental silver. The lead is tapped off and some of the cadmium is distilled. The melt residues then are brought above the melting point of zinc under cover of an unsaturated hydrogen polysulfide or alkali metal polysulfide. The zinc is tapped and the polysulfide is reused.

6 Claims, 1 Drawing Figure

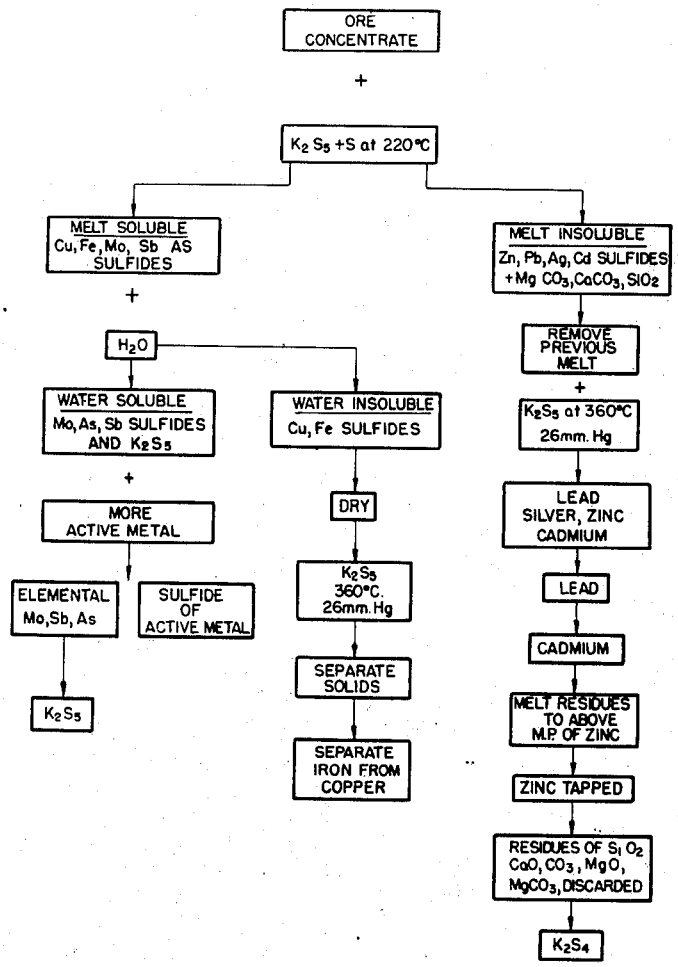

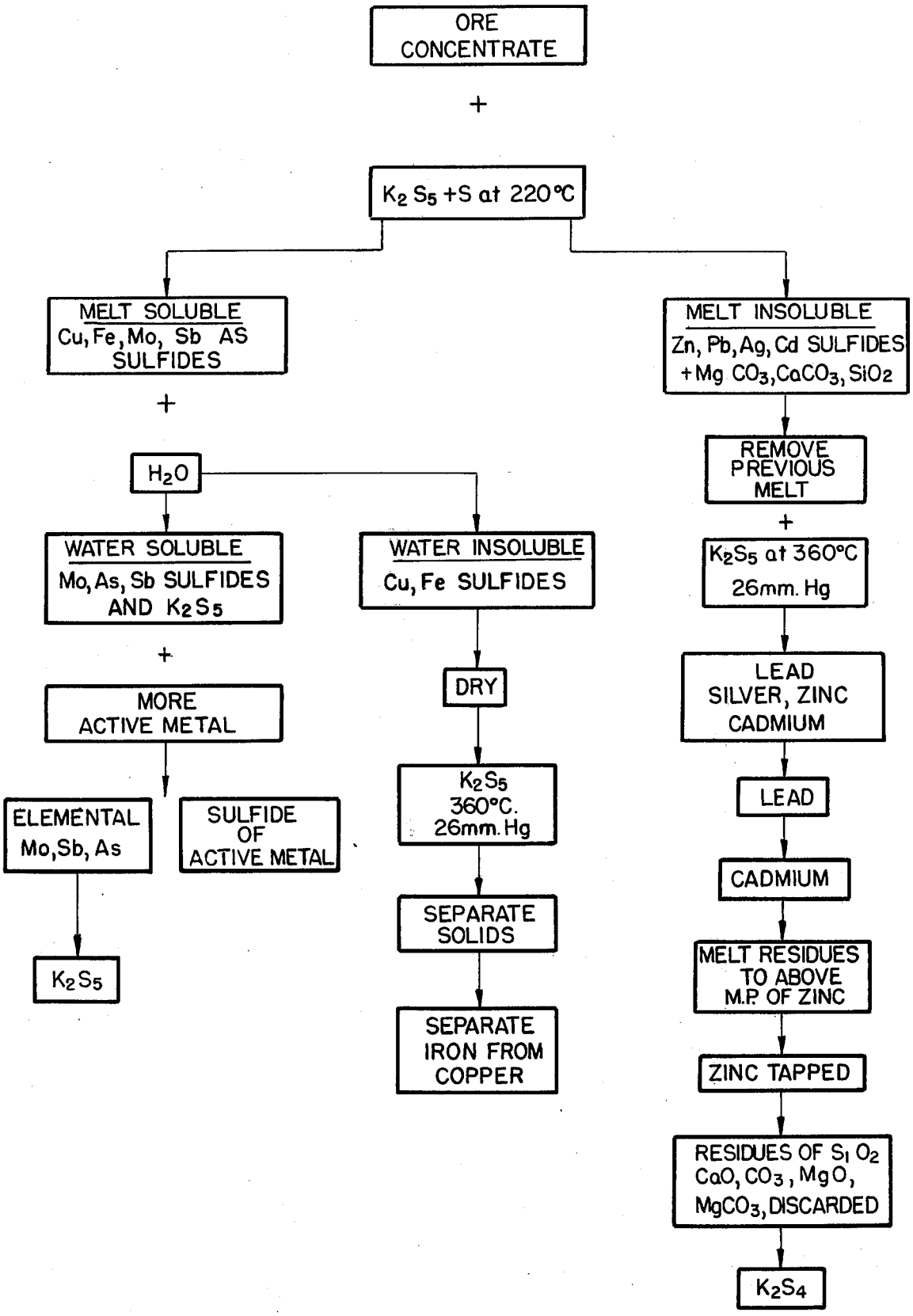
ORE CONCENTRATE
+
$K_2S_5$ +S at 220°C
MELT SOLUBLE
Cu, Fe, Mo, Sb AS SULFIDES
+
$H_2O$
WATER SOLUBLE
Mo, As, Sb SULFIDES AND $K_2S_5$
+
MORE ACTIVE METAL
ELEMENTAL Mo, Sb, As
SULFIDE OF ACTIVE METAL
$K_2S_5$
WATER INSOLUBLE
Cu, Fe SULFIDES
DRY
$K_2S_5$ 360°C. 26mm. Hg
SEPARATE SOLIDS
SEPARATE IRON FROM COPPER
MELT INSOLUBLE
Zn, Pb, Ag, Cd SULFIDES + Mg $CO_3$, $CaCO_3$, $SiO_2$
REMOVE PREVIOUS MELT
+
$K_2S_5$ at 360°C 26mm. Hg
LEAD SILVER, ZINC CADMIUM
LEAD
CADMIUM
MELT RESIDUES TO ABOVE M.P. OF ZINC
ZINC TAPPED
RESIDUES OF $S_1O_2$ CaO, $CO_3$, MgO, $MgCO_3$, DISCARDED
$K_2S_4$

ORE TREATMENT PROCESS

CROSS-REFERENCE TO CO-PENDING APPLICATION

This application is a continuation in part of my earlier U.S. patent application, Ser. No. 467,099 filed, May 6, 1974 now U.S. Pat. No. 3,957,503.

BACKGROUND OF THE INVENTION

This invention relates to a process for treating ores containing copper, zinc, arsenic, iron, antimony, silver, gold, cadmium and molybdenum which uses the alkali metal soluble sulfides of copper, iron, arsenic, antimony and molybdenum to separate from melt-insoluble metal sulfides and to reduce metal sulfides to the elemental state with the formation of alkali metal sulfides of higher sulfur content.

STATEMENT OF THE PRIOR ART

In the prior art, the Orford process used a melt of sodium sulfide to dissolve and separate copper and iron sulfides from one another. Undesirably, temperatures of 900° to 1200° C. were required to melt sodium sulfide. Another disadvantageous feature of the prior art process was that 4 to 5 hours were required to dissolve the soluble metal sulfides in the melt.

SUMMARY OF THE INVENTION

According to the present invention, an ore containing the following metals: iron, copper, zinc, arsenic, antimony, molybdenum, silver and calcium is heated to a temperature of 206° C. at one-half Torr but below 300° C at 760 mm in a melt consisting of a saturated hydrogen polysulfide or alkali metal polysulfide containing enough sulfur to sulfidize those metals not in their sulfide form and to completely oxidize the metal sulfides in the ore to their highest valence. The solubility of those metal sulfides soluble in the polysulfide and sulfur melt, is much greater when the metals are in their highest state of oxidation. This additional sulfur at the low temperature of the melt serves to oxidize these metals to their more readily soluble higher oxidation states. The solubility time is on the order of 10–15 minutes.

The sulfide forms of copper, iron, molybdenum, arsenic and antimony are separated from the melt insoluble sulfide forms of zinc-lead-silver-cadmium.

The sulfide complexes of arsenic, antimony, and molybdenum formed in the melt are both water soluble and melt soluble. The copper sulfide is practically water insoluble and the iron sulfide is insoluble at neutral pH. Addition of water to the room temperature cooled melt gives a further separation of the copper-iron sulfides from the water soluble molybdenum, arsenic and antimony sulfides. Potassium pentasulfide is very soluble in hot or cold water and is the only polysulfide of potassium stable in hot water. For that reason, it is the preferred polysulfide. The liquids and the solids can be separated.

By this procedure, the sulfides and certain non-sulfide metal forms can be separated into three groups of sulfides.

1. Molybdenum, arsenic and antimony sulfides in water solution with the polysulfide.
2. Copper and iron sulfides as solids removed from the water solution of poly sulfide.
3. Melt insoluble sulfides of zinc, lead, cadmium and silver.

A crude separation of the molybdenum, arsenic and antimony from their sulfide forms can be made by their replacement from solution by a more active metal.

The polysulfide is evaporated to dryness and used to treat additional concentrate after the solids have been removed.

The invention will be better understood by referring to the accompanying FIGURE which is a flowsheet showing the best mode presently known for carrying out the process.

While the use of polysulfides of potassium is preferred in the present process, it should be understood that the polysulfides of hydrogen, rubidium, cesium and sodium are also suitable.

The greater the activity of the metal forming the soluble sulfide the greater the propensity to acquire sulfur by the metal's sulfide or polysulfide. Potassium forms a complete range of sulfides from the mono to the pentasulfide. Rubidium forms a range from the mono to the hexasulfide. Sodium forms no tri-sulfide and probably no pentasulfide. Rubidium hexasulfide, potassium penta-sulfide, and sodium tetra-sulfide are considered the sulfur saturated forms. Sulfur is soluble in the saturated polysulfides but does not form definite compounds.

With respect to the various steps of the process, it will be understood that these need be performed only if required by the presence of certain metals whose extraction is required, or where such metals are present in sufficient quantities.

As used herein, the term "saturated" as applied to the polysulfides refers to those sulfides which contain the maximum number of sulfur atoms possible for the valence of the given metal. The term "unsaturated" refers to those polysulfides which have less than the maximum number of sulfur atoms permitted by the valence of the metal.

Referring now to the accompanying flow sheet, an ore concentrate containing typically zinc, lead, copper, iron, cadmium, antimony, arsenic and silver in sulfide or other form, together with $CaCO_3$, $MgCO_3$ and $SiO_2$ is heated to between 220° C and under 300° C in order to expel as much moisture as possible and to partially decompose certain carbonate forms of the carrying gangue. A reduced atmospheric pressure of 26 mm mercury is advantageous if much calcium or magnesium carbonate is present.

A melt of potassium pentasulfide which has additional sulfur dissolved in it, is used to treat the dehydrated concentrate at a temperature of between 220° C and 260° C. at atmospheric pressure. The concentrate and the melt are at the same temperature when mixed with agitation in a tubular zone such as an iron or nickel tube. The sulfide melt serves to sulfidize certain non-sulfide metal forms present in the concentrate; and to bring the metals present in sulfide form, in the concentrate, to their highest state of oxidation.

The quantity of sulfur added to the melt is determined by the quantity of metal forms present susceptible to sulfidizing, and the amount of sulfur required to put the sulfide forms in their highest state of oxidation.

This additional sulfur also puts copper and iron in higher states of oxidation rendering them more readily melt soluble. This is a solution of these sulfides and not a liberation of metal.

Next, the insoluble sulfides of zinc, lead, silver, and cadmium together with $MgCO_3$, $CaCO_3$, and $SiO_2$ are separated by filtering from the clear melt containing the melt soluble sulfides (Ca, Fe, Mo, Sb, As). The clear melt then is cooled to above the melting point of the polysulfide solvent and leached with water at a temperature of below 100° C.

This step separates the water soluble sulfides (Mo, As, Sb) and $K_2S_5$ from the water insoluble copper and ferric sulfides. The water treatment causes some deposition of $Mo_5S_3$. The remaining Mo, As and Sb are replaced in aqueous solution by a more electropositive metal and deposit in elemental form. The replacing metal should form an insoluble sulfide so that it can be recovered during the process. Zinc is the preferred metal for this purpose. After the liquids and solids are separated, the liquid is evaporated to dryness to recover the $K_2S_5$ for recycle.

The water-insoluble cupric and ferric sulfides are dried completely and heated to 340° to 360° C. A melt of $K_2S_5$ containing no added sulfur is heated to the same temperature. The melt and sulfides are mixed under a pressure of around 26mm Hg. Under these conditions of temperature and pressure, the potassium becomes ionic and the other metals are deposited in elemental form. The melt cover and the partial vacuum protects the elemental particles from reacting with sulfur or oxygen. The solid metals are physically separated from the melt. Then iron is separated magnetically from copper using a suitable magnet or electromagnet.

Considering now the right hand side of the flow sheet, the melt insoluble materials (Zn, Pb, Ag, Cd, in sulfide forms with $MgCO_3$, $CaCO_3$ and $SiO_2$) are separated from the melt by hot filtration. Then the solids are mixed with $K_2S$ at around 360° C at 26mm Hg. At this temperature, the molten lead dissolves 0.6% of its own weight of zinc and all the elemental silver present and whatever cadmium does not dissolve over. The molten lead is run off and bulk of the melt is removed. Letting the lead stand at its melting point, particularly in vacuo, will distill off the elemental cadmium. This cadmium can be recovered by condensation.

The lead is further treated to remove the silver by the Park process. A thin layer of molten zinc (419° C) is added to the lead which has been brought to the temperature of molten zinc. The silver and residual cadmium will collect in the molten zinc layer and leave the molten lead. The temperature is let fall to above the melting point of lead but below the melting point of zinc. The zinc layer will soldify on the surface of the molten lead. This zinc layer is removed and burned to zinc oxide + elemental silver. The silver is recovered as is zinc oxide. The lead will still contain its 0.6% zinc content. This is ordinarily removed by passing hot air through the molten lead. This will oxidize the zinc to zinc oxide which will form on the surface of the molten lead. This zinc oxide is recovered and the lead is deemed pure.

The majority of the zinc is still in a non-melted state. It is melted at above 419° C. The zinc does not react with the carrying gangue floating on the surface of the molten zinc. The molten zinc is run off and is of good quality—between electrolytic grades and better than prime western grades.

The carrying gangue is either discarded or further separated to give excellent silica, lime and the dolomites will have been decomposed in melting the zinc and magnesium oxide will remain. This can be recovered.

The calcium, magnesium and silica compounds are isolated from the melt by skimming and discarded. The $K_2S_4$ is clarified for reuse.

Elemental sulfur is distilled during treatment and reduction to metal of the members of the copper-iron group and of the zinc lead group. Distilled cadmium can be condensed prior to the solidification of sulfur under the vacuum conditions used. In treating these concentrates, it has been desirable to distill the sulfur below the melting point of zinc. This is what led to the pressure of 26 mm. mercury and 340°–360° C being used.

Sulfur from the copper-iron or zinc-lead sulfide groups is acquired by potassium (atomic) becoming ionic in the replacement of the less active metals. These metals in turn, become atomic when replaced from their ionic states. The acquired sulfur, in this reaction is ionic. The sulfur in the process becomes atomic during the decomposition of the mono-sulfide, (perhaps in the decomposition of the pentasulfide), and during its presence in the polysulfide ion.

The amount of sulfur that is present in ionic and atomic coordinated form is limited by the amount of potassium present. The thermal vacuum decomposition of the polysulfides will both produce sulfur atoms for further coordination into higher sulfur content polysulfides, and distill sulfur from the melt. The distilled sulfur is octa-atomic sulfur. This sulfur is essentially rhombic sulfur, amorphous sulfur cannot be obtained from polysulfides in appreciable quantities. The rate of reaction can be controlled by the pressure involved and the temperatures involved.

Under constant temperature and vacuum conditions, with an adequate supply of fresh sulfide concentrate, an equilibrium between distilled and acquired sulfur will be established.

The melt must be kept in anhydrous condition. Potassium and the other metals being liberated from their sulfide forms, cannot united with atomic sulfur when some water is not present. Nor can potassium or these metals in atomic form united with oxygen in the absence of water.

None of the metals liberated from their sulfide forms can unite with any sulfide ion or sulfide complex in the presence of atomic potassium.

The polysulfides must be prepared in an exact manner, free of water, hydrosulfides, thiosulfates, sulfites, thionates and sulfates. The reagent polysulfide is then maintained in pure form during its use in the process. This is done by exclusion of air and water during the process. The polysulfide when not is use is maintained at at least 100° C to prevent these hygroscopic or deliquescent substances from attracting atmospheric moisture. During the process, the equipment is always full of concentrate and polysulfide melt. This reduces atmospheric exposure. When the pentasulfide is freed of arsenic, antimony, copper and iron sulfides by dissolving the pentasulfide in water, the solution should be made under an inert atmosphere or under vacuum conditions. The pentasulfide is the form least susceptible to formation of compounds in water solution.

Preparation of the potassium polysulfides free from any compounds or substances other than potassium and sulfur is essential to the process. It is equally important to the ongoing process to maintain the potassium polysulfides pure.

The invention is further illustrated by the following specific examples but it will be understood that the invention is not limited thereto. The parts given are by weight unless volumes of liquid are specified.

EXAMPLE I

Nadina concentrate containing 50% zinc or 75% zinc sulfide was preheated at 229° C on a hot plate in a erlenmeyer flask, for one hour to dehydrate it. The zinc sulfide weight of 97.38 was multiplied by a factor of 1.33 (75% zinc sulfide concentrate content) and gave 129. Accordingly, 129 grams of the concentrate was mixed with 64 grams of sulfur (when the concentrate had cooled to around 150° C.) To this mixture was added 56 grams of potassium hydroxide and the flask containing the sulfur, concentrate and the potassium hydroxide was placed on a hot plate surface which was set for 351° C and the flask was placed under a vacuum of 26mm Hg with an evacuation rate of 1 cu. feet per minute. No agitation was supplied—though this would have been desirable. These conditions (heat vacuum) were maintained for two hours. The reaction was:

| | | | | | | | |
|---|---|---|---|---|---|---|---|
| 2 ZnS + | 2 S + | 2 KOH = | $K_2S_4$ | + Zn + | ZnO + | H20 + | S |
| 129. 97.38 | 64 | 56 | ½ (206) | ½(65.38 | ½ 81.38 | ½(18) | |

The excess sulfur was fumed off by the decomposition of $K_2S_5$ at 300° C. The flask was cooled with the vacuum maintained. When cool, the contents were extracted with methanol. It took 1/3rd gallon to extract the flask contents in numerous washings.

The zinc oxide passed a No. 4 filter paper and settled at the bottom of the filtering flask, with the filtrate. It was then separated from the liquids by adding the filtrate to a separatory funnel and allowing the solids (ZnO) to come through first and then closing the stopcock.

The elemental zinc was separated from the filter paper residues by simple panning using methanol as the liquid. Recoveries approximated those of the above reaction.

EXAMPLE II 129 grams of the concentrate (containing 1 atomic weight of ZnS) 97.38 grams, was preheated for one hour at 229° C, hot plate surface temperature, to drive out as much moisture as possible. The concentrate was ground in a mortar before being heated.

The sulfur concentrate was added to potassium hydroxide (56 grams) and the mixture placed on a hot plate surface at 351° C and under vacuum with a pump rating of 26mm Hg and an evacuation rate of one cubic foot/minute. These conditions were maintained for two hours.

After two hours the heat was turned off, but the vacuum was maintained until the flask and its contents were completely cool.

The contents of the flask were extracted in repeated washes with methanol. One third gallon of methanol was used in this extraction. The extracted mixture was filtered (No. 4 filter). Zinc oxide passed the filter and was retained with the filtrate. Elemental zinc remained in the filter paper residue. The methanol solution of potassium tetrasulfide also constituted the majority of the filtrate.

Upon standing, the zinc oxide separated and collected at the bottom of the filtrate flask. The zinc oxide was separated by means of a separatory funnel. The zinc oxide was washed with methanol. This wash methanol was added to the methanol-potassium tetrasulfide filtrate. The methanol-potassium sulfide (tetra) filtrate was evaporated under mild heat (80° C) and the previous vacuum conditions. The elemental zinc in the filter paper residue was separated by gravity means from the lighter solids.

The excess sulfur had been distilled off during the two hour heating-vacuum treatment-potassium sulfide (penta) decomposes at 300° C and under vacuum (exclusion of oxygen) decomposes to a lower sulfur content polysulfide — with intermediate reactions occuring.

The reaction was made up in grams-the recoveries were as follows:

| | | | | |
|---|---|---|---|---|
| ½ (2 ZnS as 75% concentrate) + 129 grams concentrate representing 97.38 grams of ZnS | ½ (2 KOH) + 56 | 2S = 64 | ½($K_2S_4$) + 103 + ½ ($H_2O$) 9 | ½(Zn + ½ZnO 32.69 40.69 |

Recoveries were $K_2S_4$ = 99 grams, Zn 32 grams, ZnO 37 grams, Water 9.5 grams. This was repeated at 10 times the quantities and the results were similar (more water was recovered than the reaction allows for)

As various possible embodiments of the above invention might be made and as various changes might be made in the operating parameters above set forth, it is to be understood that all matter herein set forth or shown in the accompanying flowsheet is to be interpreted as illustrative and not in a limiting sense.

Having thus described my invention, I claim as new and desire to secure by Letters Patent:

1. A process for extracting an ore containing a metal selected from the group consisting of: iron, copper, zinc, arsenic, antimony, molybdenum, silver and cadmium, said metals being present in either their sulfidic or oxidic forms, comprising preheating said ore to a temperature sufficient to dehydrate same; mixing said ore at said temperature with a anhydrous, air-free melt containing a compound selected from the group consisting of saturated hydrogen and alkali metal polysulfides and an amount of sulfur sufficient to sulfidize those metals present in their oxidic form and to completely oxidize those metals present in their sulfide forms; separating by filtering while hot the melt-soluble sulfides of Mo, As, Sb, Cu, and Fe from the melt-insoluble sulfides with water to separate said saturated polysulfide and the water-soluble sulfides of Mo, As and Sb from the water-insoluble sulfides of Cu and Fe; mixing said water-soluble sulfides in aqueous solution with a more electropositive metal thereby precipitating said metals in their elemental form together with the sulfide of said more electropositive metal and said saturated polysulfide, drying said water-insoluble copper and iron sulfides; reacting copper and iron sulfides with a melt containing a saturated hydrogen or alkali metal polysulfide at a temperature above the melting point of said polysulfide under a vacuum of between one-half Torr and 760 mm; separating the resulting free metals from said melt and magnetically separating said iron from said copper; treating said melt-insoluble Zn, Pb, Ag, and Cd sulfides with a saturated hydrogen or alkali metal polysulfide under a vacuum of between 1/2 Torr and 760 mm; separating lead containing Cd, Ag, and Zn dissolved therein; placing a cover layer of an unsaturated hydrogen or alkali metal polysulfide over said lead, heating the resulting mixture above the melting point of zinc to distill said zinc and collecting said zinc.

2. The process of claim 1, wherein said saturated polysulfide is $K_2S_5$ and said unsaturated polysulfide is $K_2S_4$.

3. The process of claim 1, wherein said ore is mixed with said melt for a contact time of 10 to 15 minutes.

4. The process of claim 1, wherein said melt soluble sulfides are treated with water at a temperature.

5. The process of claim 1, wherein the sulfide of the more electropositive metal, the metals liberated thereby and said saturated polysulfide are separated by gravity, and said polysulfide is recycled.

6. The process of claim 1, wherein said ore contains also $MgCO_3$, $CaCO_3$, and $SiO_2$ which are melt insoluble.

* * * * *